US007270091B2

(12) United States Patent
Matsui et al.

(10) Patent No.: US 7,270,091 B2
(45) Date of Patent: Sep. 18, 2007

(54) COOLING WATER PASSAGE STRUCTURE FOR AN ENGINE

(75) Inventors: Satoshi Matsui, Okazaki (JP); Toshihiko Oka, Anjyo (JP); Koichi Yoshimoto, Moriguchi (JP); Yoshinori Sakurai, Okazaki (JP); Akimasa Yamamoto, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/246,093

(22) Filed: Oct. 11, 2005

(65) Prior Publication Data

US 2006/0081201 A1 Apr. 20, 2006

(30) Foreign Application Priority Data

Oct. 12, 2004 (JP) ..... 2004-297831

(51) Int. Cl.
*F02F 1/36* (2006.01)

(52) U.S. Cl. ..... 123/41.82 R; 123/193.5

(58) Field of Classification Search ..... 123/41.82 R, 123/41.82 A, 193.5
See application file for complete search history.

(56) References Cited

FOREIGN PATENT DOCUMENTS

| | | | |
|---|---|---|---|
| JP | 02016320 A | * | 1/1990 |
| JP | 2-43025 B2 | | 9/1990 |
| JP | 2001234807 A | * | 8/2001 |

* cited by examiner

*Primary Examiner*—Noah P. Kamen
(74) *Attorney, Agent, or Firm*—Birch, Stewart, Kolasch & Birch, LLP

(57) ABSTRACT

A pair of exhaust ports (4, 4) have flat portions (9, 9) formed on respective inner peripheral surfaces thereof and facing in directions opposite to each other. An intervening cooling water passage (14) is formed between the flat portions (9, 9) when a cylinder head (1) is cast.

8 Claims, 3 Drawing Sheets

COOLING WATER PASSAGE STRUCTURE FOR AN ENGINE

BACKGROUND OF THE INVENTION

1. Field of the Invention

The present invention relates to a cooling water passage structure for an engine wherein a cooling water passage is formed between a pair of exhaust ports.

2. Description of the Related Art

A cylinder head of an engine has an exhaust port for passing exhaust gas therethrough, and thus the portion of the cylinder head surrounding the exhaust port is heated to high temperatures, as is commonly known. Especially, in a four-valve engine having a pair of exhaust ports formed in a cylinder head thereof, knocking is liable to occur as the heat of the exhaust gas accumulates in the region between the exhaust ports, which is a primary cause of lowering in the engine performance. To eliminate the inconvenience, a cooling water passage structure having a cooling water passage formed between two exhaust ports has been proposed, for example, in Examined Japanese Patent Publication No. H02-43025 (hereinafter referred to as the patent document).

In the cooling water passage structure disclosed in the patent document, a pair of cooling water passages are formed by drilling so as to cross each other in the form of the letter X and located between the ignition plug and the pair of exhaust ports. The cooling water passages permit the heat of the exhaust gas passing through the exhaust ports to escape to the cooling water in the cooling water passages, thereby preventing heat transfer to the ignition plug. To form the cooling water passages by mechanical machining, namely, by drilling, however, a special machining step is required, giving rise to a problem that additional labor and time accompanying the machining step leads to an increase in the manufacturing cost.

Such cooling water passages located between the exhaust ports may be formed by casting as cast holes, but there is no sufficient space between the two exhaust ports. Especially in the case of a small-sized engine, it is difficult to form a cooling water passage between two exhaust ports by casting.

SUMMARY OF THE INVENTION

An aspect of the present invention is directed to a cooling water passage structure for an engine, including a cylinder head and a pair of exhaust ports formed in the cylinder head, comprising: flat portions formed on inner peripheral surfaces of the respective exhaust ports and facing in directions opposite to each other; and an intervening cooling water passage located between the exhaust ports, the intervening cooling water passage being formed between the exhaust ports when the cylinder head is cast, such that the intervening cooling water passage is located between the flat portions.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

A cooling water passage structure for an engine according to one embodiment of the present invention will be hereinafter described with reference to the drawings.

Figure 1:
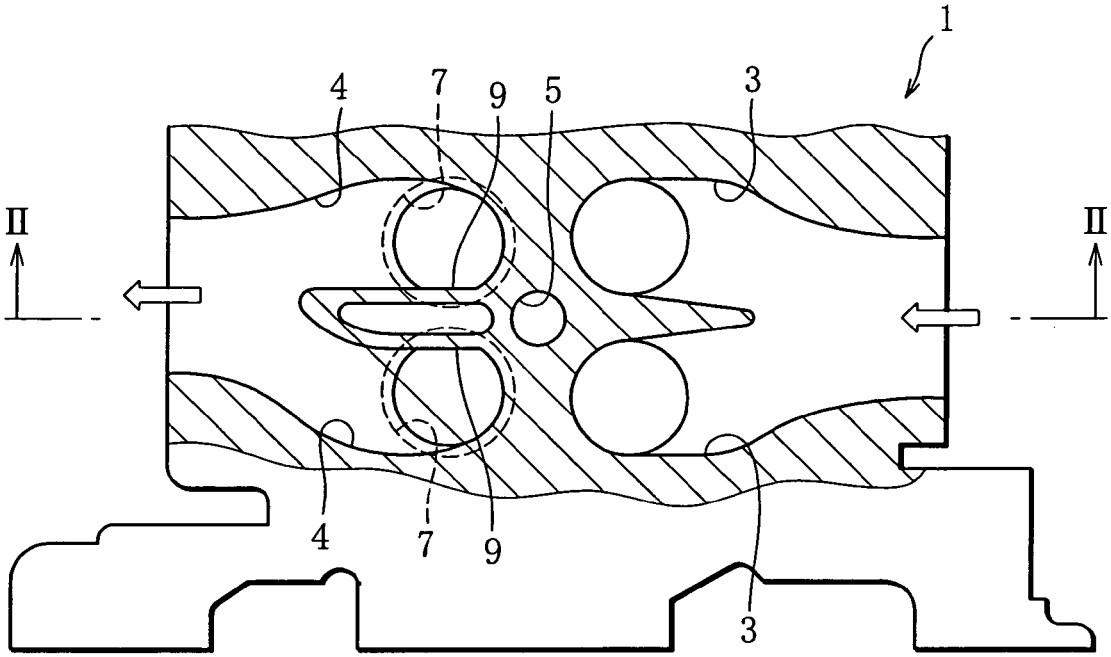
FIG. 1 is a partly sectional plan view of a cylinder head of an engine to which a cooling water passage structure according to an embodiment of the present invention is applied.
Figure 2:
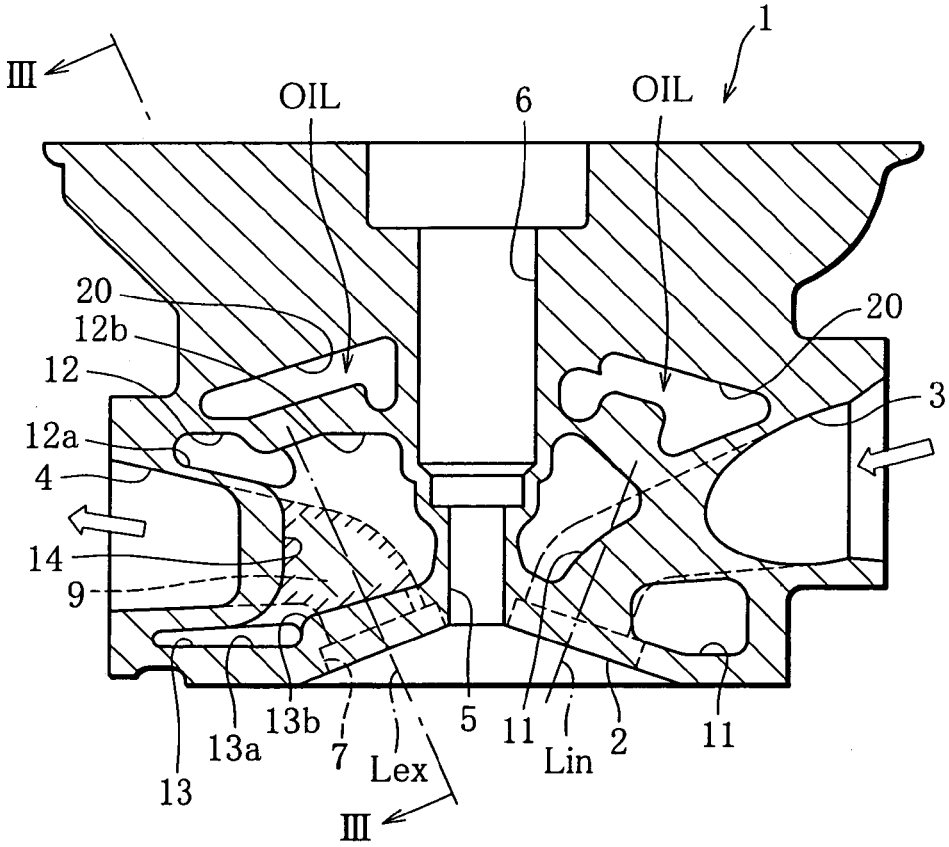
FIG. 2 is a sectional view taken along line II-II in FIG. 1, showing a cooling water passage located between exhaust ports.

An engine to which the embodiment of the invention is applied is an in-line three-cylinder four-valve gasoline engine, and FIG. 1 shows part of a cylinder head 1 of the engine corresponding to one cylinder. As shown in FIG. 2, a pent roof type combustion chamber 2 is formed in a lower surface of the cylinder head 1. When the engine is viewed from its front side as in FIG. 2, one end of a pair of intake ports 3 open in the right-hand inclined surface of the combustion chamber 2, and one end of a pair of exhaust ports 4 open in the left-hand inclined surface of the combustion chamber 2. The intake ports 3 join together and open at the other end in the right-hand side surface of the cylinder head 1. Similarly, the exhaust ports 4 join together and open at the other end in the left-hand side surface of the cylinder head 1.

A tapped hole 5 is formed so as to open in the center of the combustion chamber 2 and also opens in the upper surface of the cylinder head 1 via a plug hole 6. An ignition plug, not shown, is fixed inside the plug hole 6 through the tapped hole 5 such that electrodes at a distal end thereof are exposed to the inside of the combustion chamber 2.

The intake and exhaust ports 3 and 4 each have an annular seat ring fitting portion 7 formed by spot facing at the opening thereof opening into the combustion chamber 2, and a seat ring, not shown, is press-fitted into each seat ring fitting portion 7. Although not shown, intake valves are arranged in the respective intake ports 3 in alignment with axes Lin, and exhaust valves are arranged in the respective exhaust ports 4 in alignment with axes Lex. Each of the intake and exhaust valves is normally closed by the force of a valve spring, with its valve head kept in close contact with the corresponding seat ring. During operation of the engine, the intake and exhaust valves are opened at respective predetermined timings by means of camshafts.

Figure 4:
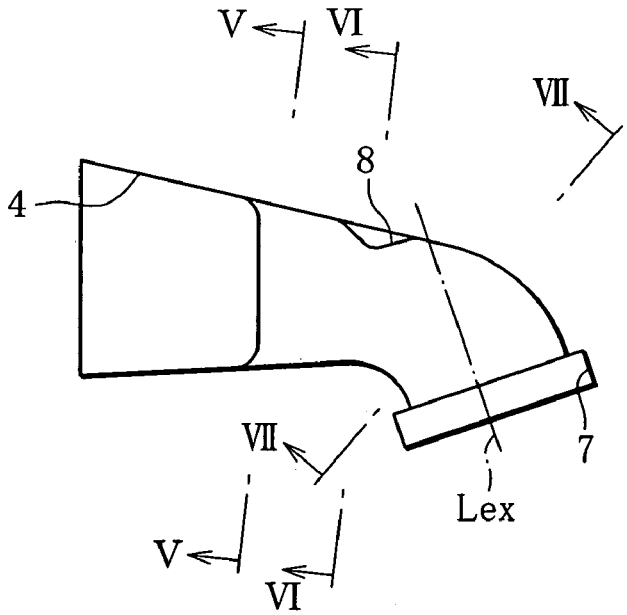
FIG. 4 is a sectional view showing the shape of the exhaust port as viewed from the same direction as in FIG. 2.
Figure 5:
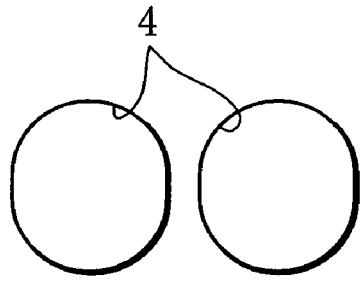
FIG. 5 is a sectional view taken along line V-V in FIG. 4, showing cross-sectional forms of the exhaust ports.
Figure 6:
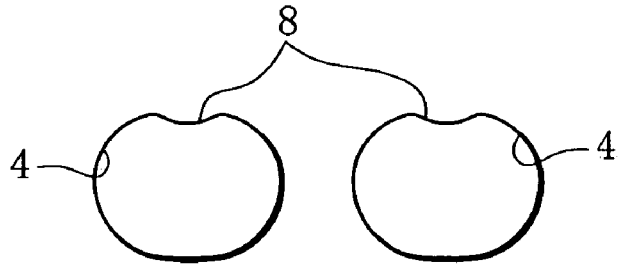
FIG. 6 is a sectional view taken along line VI-VI in FIG. 4, similarly showing cross-sectional forms of the exhaust ports.
Figure 7:
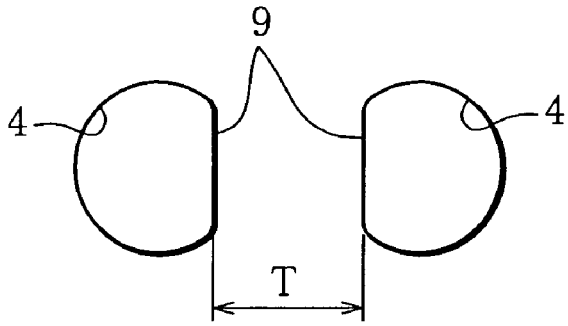

The exhaust ports 4, of which the shape is clearly shown in FIG. 4, have different cross-sectional forms at different portions thereof along the direction of flow of exhaust gas, as shown in FIGS. 5 to 7. Downstream portions of the exhaust ports near the junction have generally circular cross-sectional forms, as shown in FIG. 5. Intermediate portions of the exhaust ports 4 where valve guides of the exhaust valves protrude toward the exhaust ports 4 have generally circular cross-sectional forms but with concaved portions 8, as shown in the upper part of FIG. 6, in order to secure sufficient wall thickness for the bases of the valve guides.

Upstream portions of the exhaust ports 4 near the seat ring fitting portions 7 have basically circular cross-sectional forms but with flat portions 9 formed on those sides of the inner peripheral surfaces of the respective exhaust ports 4 which are closest to each other, as shown in FIG. 7. The flat portions 9 are parallel and face in directions opposite to each other. Because of the flat portions 9, a wall thickness T of the cylinder head separating the exhaust ports 4 from each other can be made significantly larger than in the case where the exhaust ports 4 have perfectly circular cross-sectional forms, for example.

As shown in FIG. 2, an oil passage 20 for collecting lubricating oil from the cylinder head 1 and guiding the collected oil to an oil pan, not shown, is formed inside the cylinder head 1. Also, inside the cylinder head 1, a cooling water passage 11 is formed under the oil passage 20 so as to extend over substantially the entire region of the cylinder head. The cooling water passage 11 is formed by using a core when the cylinder head 1 is formed by casting. During operation of the engine, cooling water supplied from the cylinder block side is circulated through the cooling water passage 11 in the cylinder head 1, whereby heat is allowed to escape from the combustion chamber 2 and the exhaust ports 4 to the cooling water so that the cylinder head 1 can be cooled.

Part of the cooling water passage 11 on one side of the cylinder head 1 extends to regions above and below the two exhaust ports 4, thereby forming upper and lower cooling water passages 12 and 13 located above and below the exhaust ports 4, respectively. The upper and lower cooling water passages 12 and 13 communicate with each other through an intervening cooling water passage 14 formed between the exhaust ports 4. Thus, the cooling water supplied from the cylinder block side to the lower cooling water passage 13 is guided to the upper cooling water passage 12 through the intervening cooling water passage 14 to cool the cylinder head.

Figure 3:
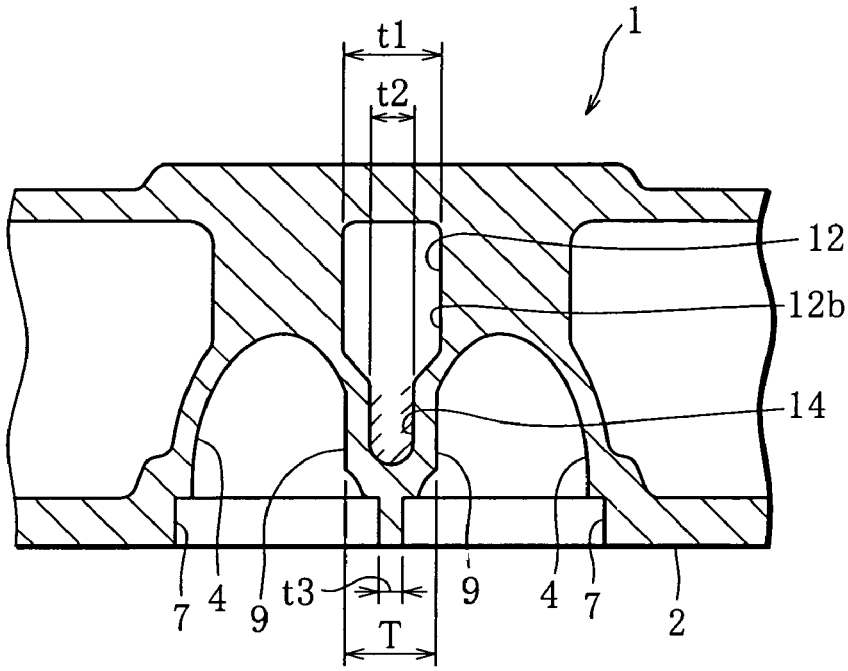
FIG. 3 is a sectional view taken along line III-III in FIG. 2, similarly showing the cooling water passage located between the exhaust ports.

In FIGS. 2 and 3, a region corresponding to the intervening cooling water passage 14 is surrounded by hatching, in order to clarify the relation of the passage 14 with the upper and lower cooling water passages 12 and 13. As shown in FIG. 2, the intervening cooling water passage 14 has a generally triangular shape, when viewed from the front of the engine, and is located near the upstream portions of the exhaust ports 4. Also, as shown in FIG. 3, the intervening cooling water passage 14 has a substantially constant width in a direction along which the exhaust ports 4 are juxtaposed (in a horizontal direction in FIG. 3) and is located between the flat portions 9 of the exhaust ports.

The intervening cooling water passage 14 is formed by using a core, together with the remaining part of the cooling water passage 11 such as the upper and lower cooling water passages 12 and 13, when the cylinder head 1 is formed by casting.

The upper and lower cooling water passages 12 and 13 respectively have main portions 12*a* and 13*a* and connecting portions 12*b* and 13*b*. The main portions 12*a* and 13*a* are widened in the port juxtaposition direction so as to cover the upper and lower sides, respectively, of the exhaust ports 4, and the connecting portions 12*b* and 13*b* with smaller widths (the connecting portion 12*b* of the upper cooling water passage 12 is shown in FIG. 3) extend from the respective main portions 12*a* and 13*a* and are connected to the upper and lower portions, respectively, of the intervening cooling water passage 14.

The width t1 of the connecting portion 12*b* of the upper cooling water passage 12 in the port juxtaposition direction, shown in FIG. 3, is set to 10 mm, for example, and the width t2 of the intervening cooling water passage 14 in the same direction is set to 3.5 mm. As shown in FIG. 3. the width t1 may be substantially the same as an interval T between the flat portions 9,9 formed on the inner peripheral surfaces of the respective exhaust ports 4,4. The interval t3 between the seat ring fitting portions 7 of the two exhaust ports 4 (t3 is not the distance between the centers of the fitting portions 7 but is the distance between the outer peripheries of the fitting portions 7) is set to 3 mm. Namely, in this embodiment, the width t2 of the intervening cooling water passage 14 is smaller than the width t1 of the connecting portion 12*b* of the upper cooling water passage 12 and at the same time is larger than the interval t3 between the seat ring fitting portions 7. The following explains why the widths and the interval are set to such values and what advantages can be obtained.

First of all, the interval t3 between the seat ring fitting portions 7 needs to be set to about 3 mm at the minimum, in order to prevent the seat rings from coming off when the temperature of the combustion chamber 2 is high. In the aforementioned conventional cooling water passage structure, the valve pitch of the exhaust valves is increased to secure a sufficient space for the cooling water passages. According to this embodiment, by contrast, the interval t3 between the seat ring fitting portions 7 is first set to a minimum value of 3 mm, and then the largest possible diameter of the seat ring fitting portions 7, that is, the largest possible valve diameter of the exhaust valves, is set taking account of restrictions imposed by the diameter of the cylinder bore.

In order to cool the exhaust ports 4, on the other hand, the cross-sectional area of the cooling water passage 11 around the ports 4 should preferably be set as large as possible. As shown in FIG. 3, a major part of the connecting portion 12*b* of the upper cooling water passage 12, except a lower part of same in the vicinity of the intervening cooling water passage 14, is located above the two exhaust ports 4. Thus, the lower part alone has to be reduced in width so as to correspond to the cross-sectional forms of the exhaust ports 4, and the width of the connecting portion 12*b* except the lower part can be set to a sufficiently large width of 10 mm without regard to the exhaust ports 4.

The intervening cooling water passage 14 is located between the two exhaust ports 4. Accordingly, the intervening cooling water passage 14 needs to be formed so as to be narrower than the wall thickness T of the cylinder head 1 separating the exhaust ports 4 from each other and the width t2 thereof should inevitably be smaller than the width t1 (10 mm) of the connecting portion 12*b* of the upper cooling water passage 12 on which no restrictions are imposed by the exhaust ports 4. Since the exhaust ports 4 are provided with the flat portions 9, however, the wall thickness T of the cylinder head 1 can be made sufficiently large and thus the width t2 of the intervening cooling water passage 14 can be increased to a considerable degree. Consequently, the width t2 of the intervening cooling water passage 14 can be set to 3.5 mm larger than the interval t3 (3 mm) between the seat ring fitting portions 7.

Thus, not only the width t1 of the connecting portion 12*b* of the upper cooling water passage 12, on which no restrictions are imposed by the exhaust ports 4, is set sufficiently large, but the width t2 of the intervening cooling water passage 14, on which restrictions are imposed by the exhaust ports 4, is set as large as possible by providing the exhaust ports 4 with the flat portions 9, whereby the upper cooling water passage 12 and the intervening cooling water passage 14 individually have a sufficiently large cross-sectional area. Accordingly, a large quantity of cooling water can be passed from the lower cooling water passage 13 to the upper cooling water passage 12 through the intervening cooling water passage 14 to efficiently cool the region between the exhaust ports 4 where the heat of the exhaust gas is liable to accumulate, thereby restraining knocking of the engine.

On the other hand, the interval t3 between the seat ring fitting portions 7 is reduced to a minimum so that the valve diameter of the exhaust valves can be set to the largest possible value without being affected by the presence of the intervening cooling water passage 14. Remarkably high exhaust efficiency can therefore be achieved, making it possible to greatly improve the engine performance in combination with the restraint of knocking.

While the embodiment of the invention has been described, it is to be noted that the present invention is not limited to the foregoing embodiment alone. For example, although in the above embodiment, the invention is embodied as a cooling water passage structure for an in-line three-cylinder four-valve gasoline engine, the invention is applicable to any engine insofar as the intervening cooling water passage 14 is formed between the two exhaust ports 4 and may be applied to a diesel engine or other types of engine with a different cylinder arrangement or a different valve layout.

Also, in the foregoing embodiment, the exhaust ports 4 are configured to have the flat portions 9 without changing the diameter or pitch of the exhaust ports 4, in order for the cylinder head 1 to have a sufficiently large wall thickness T separating the exhaust ports 4 from each other. The method of securing a sufficiently large wall thickness is, however, not limited to that employed in the above embodiment insofar as spacing the exhaust ports 4 apart from each other does not lead to reduction in the valve diameter of the exhaust valves, unlike the conventional structure. Thus, the diameter of the exhaust ports 4 may be reduced to such an extent as not to lower the exhaust efficiency or the pitch or interval between the exhaust ports 4 may be increased to thereby secure a sufficiently large wall thickness T.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling water passage structure for an engine including a cylinder head and a pair of exhaust ports formed in the cylinder head, the cooling water passage structure comprising:

flat portions formed on inner peripheral surfaces of the respective exhaust ports and facing in directions opposite to each other; and an intervening cooling water passage located between the exhaust ports, the intervening cooling water passage being formed between the exhaust ports when the cylinder head is cast, such that the intervening cooling water passage is located between the flat portions.

2. The cooling water passage structure according to claim 1, wherein said intervening cooling water passage communicates at least with an upper cooling water passage located above the exhaust ports and has a width, as viewed in a direction along which the exhaust ports are juxtaposed, smaller than a width of the upper cooling water passage and larger than an interval between seat ring fitting portions formed at combustion chamber side openings of the respective exhaust ports.

3. The cooling water passage structure according to claim 2, wherein the width of the upper cooling water passage is substantially equal to an interval between the flat portions formed on the inner peripheral surfaces of the respective exhaust ports.

4. The cooling water passage structure according to claim 2, wherein said intervening cooling water passage communicates with an lower cooling water passage located below the exhaust ports.

5. A cooling water passage structure for an engine including a cylinder head and a pair of exhaust ports formed in the cylinder head, the cooling water passage structure comprising:

flat portions formed on inner peripheral surfaces of the respective exhaust ports and facing in directions opposite to each other; and an intervening cooling water passage located between the exhaust ports, the intervening cooling water passage being formed between the exhaust ports, such that the intervening cooling water passage is located between the flat portions.

6. The cooling water passage structure according to claim 5, wherein said intervening cooling water passage communicates at least with an upper cooling water passage located above the exhaust ports and has a width, as viewed in a direction along which the exhaust ports are juxtaposed, smaller than a width of the upper cooling water passage and larger than an interval between seat ring fitting portions formed at combustion chamber side openings of the respective exhaust ports.

7. The cooling water passage structure according to claim 6, wherein the width of the upper cooling water passage is substantially equal to an interval between the flat portions formed on the inner peripheral surfaces of the respective exhaust ports.

8. The cooling water passage structure according to claim 6, wherein said intervening cooling water passage communicates with an lower cooling water passage located below the exhaust ports.

* * * * *